United States Patent [19]

Kalantarov et al.

[11] Patent Number: 4,768,835

[45] Date of Patent: Sep. 6, 1988

[54] ADVANCING SYSTEM FOR COAL WINNING MACHINE

[75] Inventors: Boris B. Kalantarov; Anatoly P. Markov, both of Moscow; Nikolai I. Stepanov, Moskovskaya; Alexandr A. Pukis; Eduard I. Fedotov, both of Moscow, all of U.S.S.R.

[73] Assignee: Gosudarstvenny Proektnokonstruktorsky I Experimentalny Institut Ugolnogo Mashinostroenia, Moscow, U.S.S.R.

[21] Appl. No.: 919,138

[22] Filed: Oct. 15, 1986

[51] Int. Cl.[4] ..... E21C 29/00

[52] U.S. Cl. ..... 299/31; 245/105; 299/43

[58] Field of Search ..... 105/31, 32; 299/31, 299/43, 56, 64; 254/105, 106, 107; 269/27, 25, 69, 58, 59

[56] References Cited

U.S. PATENT DOCUMENTS

| | | | |
|---|---|---|---|
| 3,754,790 | 8/1973 | Mappin et al. | 299/31 |
| 3,821,934 | 7/1974 | Maeda | 105/31 X |
| 3,832,945 | 9/1974 | Muto et. al. | 254/107 X |
| 4,212,450 | 7/1980 | Lambert | 254/105 X |

FOREIGN PATENT DOCUMENTS

| | | | |
|---|---|---|---|
| 1291427 | 10/1972 | United Kingdom | 299/43 |
| 2038903 | 7/1980 | United Kingdom . | |
| 1579484 | 11/1980 | United Kingdom . | |

*Primary Examiner*—Stephen J. Novosad
*Assistant Examiner*—David J. Bagnell
*Attorney, Agent, or Firm*—Fleit, Jacobson, Cohn & Price

[57] ABSTRACT

The advancing system for a coal winning machine comprises a guide installed along a face conveyor, and an advancing mechanism connected with the machine. The advancing mechanism is accommodated in a separate housing and has at least two successively communicating pairs of advancing hydraulic cylinders with slides hinged to each of said cylinders. The guide is provided with rack-type engagement elements and secured to the end heads of the face conveyor. Each one of the slides has grips for holding on the guide, and a hydraulic cylinder. Each hydraulic cylinder of the slides is connected to its fixing bar the latter being installed with a provision for being arranged and fixed between the engagement elements of the guide.

9 Claims, 3 Drawing Sheets

ADVANCING SYSTEM FOR COAL WINNING MACHINE

FIELD OF USE

The present invention relates to mechanization of underground winning of minerals and more particularly, to the advancing systems for coal winning machines.

The invention can be used to advantage as an advancing system for various machines and mechanisms or as a transport means in the cases where considerable forces are required for movement.

Most successfully the present invention can be utilized for advancing narrow-cut shearers or ploughs along the face.

BACKGROUND OF THE INVENTION

The growing power of machines, increased output per face, higher degree of mechanization and safety of all operations involved in the use of a mechanized complex pose a problem of developing an advancing system with high power, kinematic and performance parameters and a high standard of safety.

The widely employed advancing systems incorporating chain traction assemblies fail to ensure the required parameters and are replaced by chainless haulage systems.

The widest recognition has been won by the haulage systems incorporating an advancing mechanism built into the machine and having a driving wheel and a traction element in the form of a rack with teeth fitted to the face conveyor.

The rack serves as a guide for the grips which prevent the cutting machine from displacement from the face conveyor and ensure the engagement of the driving wheel of the advancing mechanism with the traction assemblies.

The chainless haulage systems promote operational safety and ensure the required power and kinematic parameters. The built-in haulage units complicate the design of the cutting machine thereby worsening its performance and interaction with the other mechanisms of the complex due to absence of adjustment of the clearance between the machine and the support elements and between the machine and the face conveyor, i.e. in the area of handling of the mined mineral.

Considerable disengagement forces in the engagement the driving wheel and the rack, fluctuations of the geometrical parameters of engagement, rack gumming conditions result in a low efficiency of the haulage units and an unjustified increase of the drive power. The complexity and high labour content required to make a sufficiently accurate rack step up manufacturing costs.

The connection of the rack with the mining machine by the grips of the haulage unit imposes considerable transverse forces on the rack which complicates the fastening of the rack to the conveyor and impairs its engagement with the driving wheel.

Known in the prior art are the walking advancing systems of a coal shearer comprising the hydraulic cylinders for advancing the machine, guides for gripping the hydraulic cylinder during the pull-up motion, fixing elements and the hydraulic systems for grip and advancement control (UK Pat. No. 2.038.903).

The shearer is advanced in the known systems by the hydraulic cylinders which are secured to the shearer body while their rods are fastened on the slides coacting with the guide. The slides are fixed either by friction or by some latching means whose lugs enter the guide slots during alternate fixing of the slides. The slides are fixed along the guide by springs and released by hydraulic cylinders. The hydraulic system provides alternation of the operating cycles, i.e. fixing of the hydraulic cylinder on the guide and the advancement of the machine.

In the known cases the guide holds the shearer in a transverse direction and is used as a traction assembly of the advancing mechanism. The combination of the advancing and holding functions in a single construction, as well as fastening minimum two hydraulic cylinders to the cutter-loader defines the mechanism as a built-in one, i.e. as an integral part of the given machine.

The known systems of walking advancing mechanisms have a number of design and operational disadvantages.

The use of friction forces for fixing fails to provide the required reliability of locking the slides due to considerable changes in the state of contacting surfaces (water, oil, coal fines, etc.).

Another known advancing system of a coal shearer comprises a guide and an advancing mechanism consisting of advancing hydraulic cylinders, slides interacting with the advancing guide, a hydraulic system and control units (UK Pat. No. 1291427).

Among the disadvantages of the known device it is worth to mention the complexity of the gripping units, probability of spring gumming, wear of lugs and latches which decreases the reliability and safety of the advancing mechanism.

Fastening the guide on the pans of the face conveyor fails to guarantee the required accuracy of snapping of mechanical latches into the guide slots. As a result, the advancing forces are transmitted to the joints of the conveyor pans while the transverse forces of the shearer, to the advancing elements which decreases the reliability of the latter.

Fastening the hydraulic cylinders to the shearer decreases the reliability of fastening of the body joints since said joints are loaded by advancing forces.

The main object of the invention is to provide an advancing system of a coal winning machine wherein the novel design of the independent advancing mechanism and guide promotes the reliability of the entire system.

BRIEF DESCRIPTION OF THE INVENTION

An object of the invention lies in increasing the reliability of the advancing system for a coal winning machine.

Another object is to increase output by ensuring high advancing parameters and improving the performance of the machine.

A further object of the invention is to promote safety of the attending personnel.

A still further object of the invention lies in cutting down the cost of the entire system.

These objects are accomplished by providing an advancing system for a coal-winning machine comprising a guide installed along the face conveyor and an advancing mechanism connected with the machine and incorporating advancing hydraulic cylinders and slides interacting with the guide wherein, according to the invention, the advancing mechanism is accommodated in a separate housing and has at least two successively-connected pairs of advancing hydraulic cylinders, each hinged to a slide, and the guide has rack-type engagement elements and is secured to the end heads of the face conveyor, each slide being provided with grips for holding on the guide and a hydraulic cylinder connected with a fixing bar which is installed with a provision for being arranged and fixed between the engagement elements of the guide.

Enclosing the advancing mechanism in a separate housing makes for versatility of its use with various machines.

The independent advancing mechanism, unlike the one built into the machine, ensures its reliable engagement with the traction element—advancing guide—which steps up the efficiency of the advancing system thereby increasing its effective power.

The independent design of the advancing mechanism simplifies the design of the machine, and strictly advancing system, which raises their reliability and cuts down manufacturing cost. The use in the herein-proposed advancing system of the guide having no transverse power ties with the machine relative to the direction of advancement simplifies the guide, curtails the manufacturing labour content and the weight of the structure, and provides for good adaptability and convenience in operation.

The herein-proposed advancing system having no rigid connection with the machine improves the operational performance of the machine and its interaction with the other mechanisms of the complex since it provides for the possibility of vertical adjustment of the position of the machine moving along the face conveyor under the support elements.

The use of hydraulic cylinders for advancing the machine along with a reliable method of mechanical fixing of the slides on the guide ensures high power parameters (traction forces) of the advancing system.

It is feasible that the hydraulic cylinders of the slides would have hydraulically-communicating rod ends, the size of the part of each fixing bar engaging the guide exceeding half the travel of the piston of the cylinder connected thereto.

It is feasible that the hydraulic cylinders of the slides would be made with successive hydraulic connection of the head ends of one cylinder with the rod end of the other.

Such interaction of the strokes of slide hydraulic cylinders with the engagement elements of the guide ensures reliable fixing of the slides and safety of advancing, since in the process of shifting of the fixing bars at least one of them is in engagement with the advancement guide.

It is expedient that the casing of the advancement mechanism should be made in the form of individual hinged pans or sections for each pair of hydraulic cylinders and slides.

The panned or sectional construction of the separate casing and the hinged jointing of the pans ensures the compliance of the advancing mechanism with the mine outline, good passability in case of curved conveyor flights and during movement through seams with distorted hypsometry.

It is practicable that in each pair of the advancing cylinder and slide the head end of the slide cylinder should be connected hydraulically in succession with the head end of the advancing cylinder so that the fluid would flow into the head end of the advancing cylinder from the head end of the slide cylinder after complete extension of the fixing bar.

The successive hydraulic connection of the slide cylinders and advancing cylinders ensures safety of advancement since the machine is advanced only after the slide has been reliably secured on the advancing guide. This, in addition, prevents breaking away of the fixing bar caused by incomplete engagement.

It is practicable that the guide be made in the form of a multiplicity of longitudinal guide pans hinged to one another by connecting links on which the engagement elements are mounted.

It is practicable that the engagement elements be made in the form of slots on the connecting links.

The herein-proposed simple design of the sectional guide reduces the metal content, the labour requirement and the manufacturing cost along with efficient adaptability to operation under the conditions of gumming.

BRIEF DESCRIPTION OF THE DRAWINGS

Now the invention will be described by an example of its embodiment with reference to the accompanying drawings in which.

DETAILED DESCRIPTION OF THE INVENTION

Figure 1:
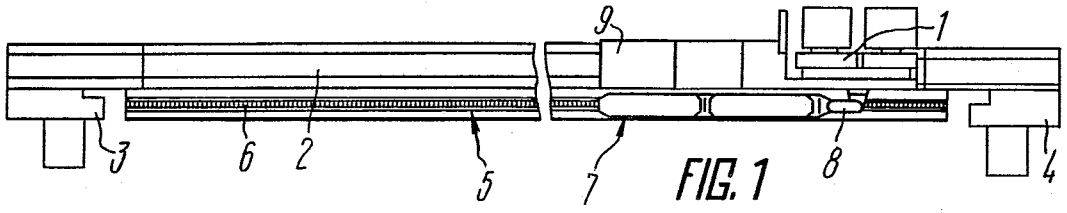
FIG. 1 shows a general view of the advancing system for a coal-winning machine according to the invention.

The advancing system for the coal-winning machine 1 (FIG. 1) is mounted on the face conveyor 2 provided with end heads 3, 4. The advancing system has a guide 5 with rack-type engagement elements 6 and is secured to the end heads 3, 4. The advancing system incorporates an advancing mechanism of the machine 1, installed in a separate housing 7 on the face conveyor 2. The advancing mechanism transmits the advancing forces to the machine 1 via hinged joint 8.

The pump pack 9 installed on the face conveyor 2 is connected with the advancing mechanism by a hydraulic system not shown in the drawing.

Figure 3:
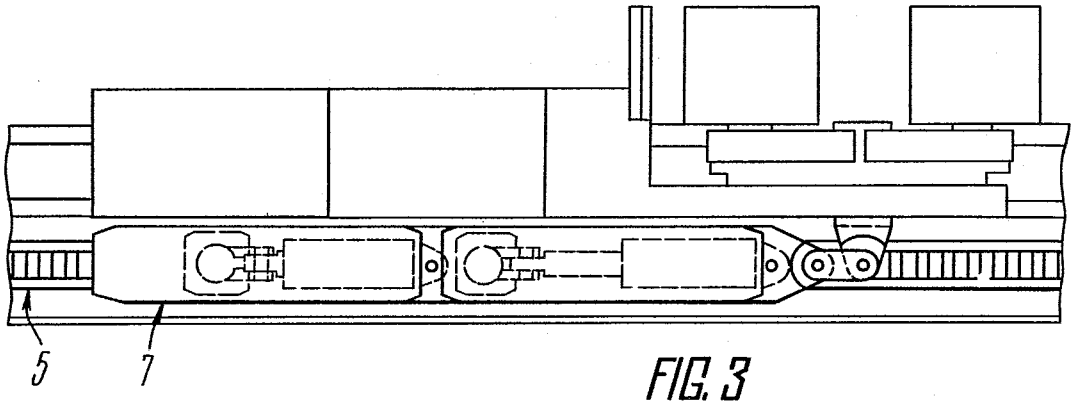
FIG. 3—same, top view.
Figure 2:
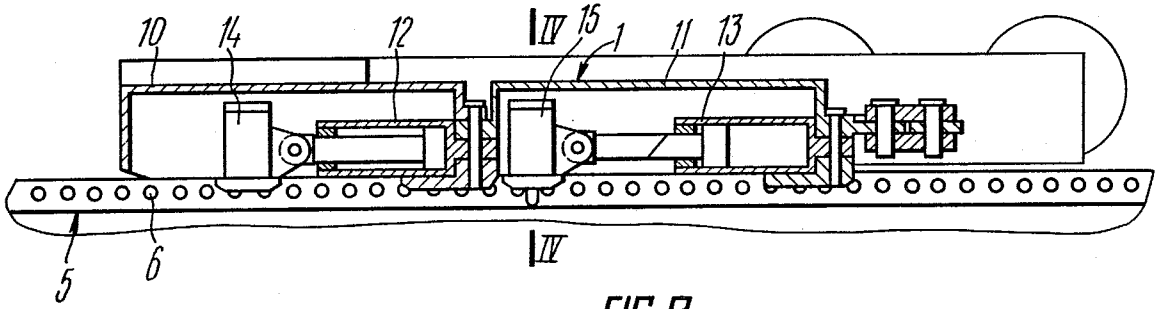
FIG. 2 is an independent advancing element of the advancing mechanism.

The advancing mechanism is installed in hinged pans or sections 10, 11 (FIGS. 2 and 3) of the split housing 7. However, the housing 7 may be of an integral construction.

The advancing mechanism is, essentially, two pairs of successively arranged advancing hydraulic cylinders 12, 13 with respective slides 14, 15 interacting with the guide 5. The hydraulic cylinders 12, 13 serve as an advancing elements of the advancing mechanism. The hydraulic cylinders 12, 13 have hydraulically connected rod end and perform simultaneously a stroke of equal length but of a contrary direction. Each advancing hydraulic cylinder 12, 13 is hinged to a respective pan 10, 11 of the advancing mechanism housing 7 and connected, also hingedly, with slides 14 and 15, respectively. The advancing hydraulic cylinder 12 and slide 14 are assembled in the pan 10 of the housing 7 whereas the hydraulic advancing cylinder 13 and slide 15 are assembled in the pan 11 of the housing 7.

Both slides 14, 15 are identical in design. To simplify the description, the design of only one slide 14 will be dealt with in detail.

The slide 14 has a body 16 (FIG. 4) with grips 17 for fixing on the guide 5. The body 16 accommodates a chamber 18 arranged perpendicularly to the guide 5. Movably installed in the chamber 18 is a fixing bar 19. The fixing bar 19 has a space 20 in which a hydraulic cylinder 21 is installed. A similar hydraulic cylinder is installed in the slide 15. The hydraulic cylinders of the slides 14, 15 have hydraulically connected rod ends. The fixing bar 19 has a fixing portion intended to interact with the engagement elements 6 of the guide 5. The fixing portion of the fixing bar 19 is made so that the size of its end "h" is greater than half the stroke "l" of the hydraulic cylinder 21. This relationship makes for the safety of advancing since the engagement elements 6 of the guide 5 interact with at least one fixing bar 19 of one of the slides 14, 15.

In another version of design, the safety of advancement can be ensured by making the hydraulic cylinders of the slides 14, 15 with the head end of the hydraulic cylinder of one slide 14 successively connected with the rod end of the similar hydraulic cylinder of the other slide 15. In this version of design there is no necessity for any relationship between the stroke of the hydraulic cylinder 21 and the size "h" of the end of the fixing bar 19.

The hydraulic connections of the mechanism 6 are made so that the hydraulic advancing cylinders 12, 13 and the hydraulic cylinders of the slides 14, 15 have communicating head ends, the fluid entering the head end of the hydraulic advancing cylinders 12 or 13 from the head end of the hydraulic cylinder of the corresponding slide 14 or 15 after full extension of the fixing bar 19, i.e. after full fixing of the slide 14 or 15 on the guide 5.

Figure 5:
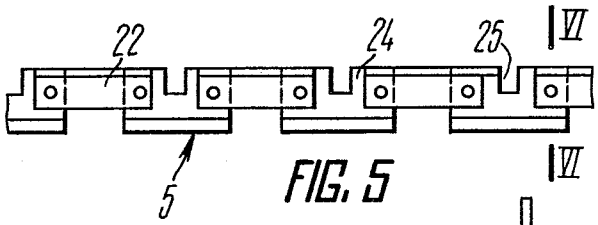
FIG. 5 is an alternative design of the advancing guide.
Figure 6:
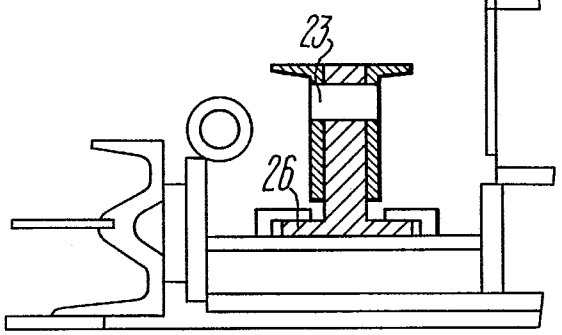
FIG. 6 is a section VI—VI in FIG. 5.
Figure 4:
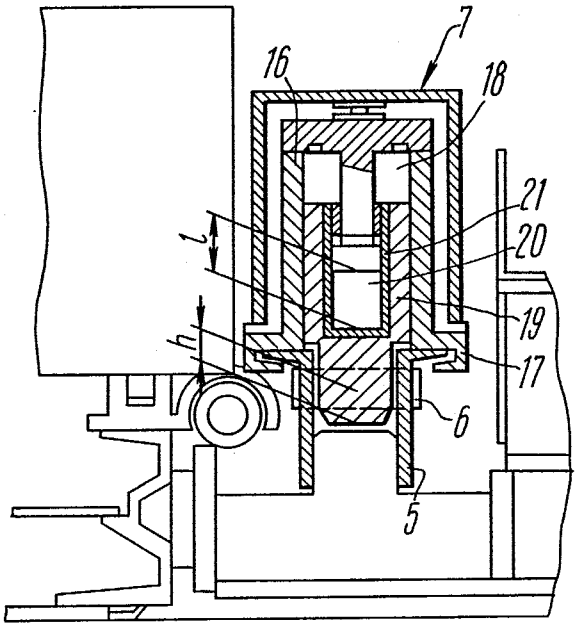
FIG. 4 is a section IV—IV in FIG. 2.

Shown in FIGS. 5 and 6 is a version of the design of the guide 5. The guide 5 consists of a multiplicity of longitudinal guide pans 22 interconnected by hinges 23 and connecting links 24. The connecting links 24 have slots 25, whose side surfaces engage each fixing bar 19 (FIG. 4). The connecting links 24 have elements 26 used for fixing the guide 5 in the plane transverse to the direction of advancing.

However, the guide 5 may be made in the form of any engagement elements suitable for this purpose.

Advancing of the coal winning machine 1 is achieved by the movement of the advancing mechanism over the guide 5 along the face conveyor 2. The advancing forces are transmitted from the mechanism to the machine 1 by a hinge joint 8.

The fluid is delivered into the hydraulic system of the advancing mechanism from the pump pack 9. The fluid enters the head end of the hydraulic cylinder 21 of the slide 14 located in the space 20 of the fixing bar 19. The hydraulic cylinder 21 moves the fixing bar 19 in the chamber 18 so that the fixing part of the bar interacts with the engagement element 6 of the guide 5. The forces of resistance to the insertion of the fixing bar 19 into the engagement elements 6 of the guide 5 are taken by the grips 17 of the housing 16 of the slide 14.

The complete travel of the hydraulic cylinder 21 ensures fixing of the slide 14 on the guide 5 due to insertion of the fixing bar 19 into the engagement elements 6. On completion of the process of fixing the slide 14, the fluid enters the head end of the hydraulic advancing cylinder 12. The advancing cylinder 12 extends and, pushing away from the fixed slide 14 moves the housing 7 of the advancing mechanism hinged to it; said mechanism moves the winning machine 8 via the hinged joint 8.

As the fluid enters the head end of the advancing hydraulic cylinder 12, the fluid is expelled from its rod end and flows into the communicating rod end of the advancing hydraulic cylinder 13. In this manner the advancing hydraulic cylinder 13 comes to the initial position concurrently with the movement of the advancing hydraulic cylinder 12. Said cylinder 12 simultaneously moves the slide 15 to the initial position; meanwhile the fixing bar of the slide 15 comes to the uppermost position and is not fixed in the engagement elements 6 of the guide 5. During its movement the slide 15 is held on the guide 5 by grips.

On completion of the full travel of the advancing hydraulic cylinder 12, the fixing of the slides 14 and 15 is changed, i.e. the fixing bar of the slide 15 is engaged by the engagement element 6 of the guide 5 while the fixing bar 19 of the slide 14 is put out of engagement. When the order of fixing is changed, the safety of advancing is ensured by a constant fixing of the advancing mechanism on the guide 5 by one of the slides 14 or 15.

On completion of the full stroke of the advancing hydraulic cylinder 12, the hydraulic system directs the fluid into the head end of the hydraulic cylinder of the slide 15. The cylinder of the slide 15 moves its fixing bar and puts it in engagement with the engagement element 6 of the guide 5. As the fluid enters the head end of the hydraulic cylinder of the slide 15, the fluid is expelled from its rod end and enters the communicating rod end of the hydraulic cylinder 21 of the slide 14. Thus, the hydraulic cylinders and, correspondingly, the fixing bars 19 of the slides 14 and 15 make strokes which are equal in length but contrary in direction. At half the stroke of the hydraulic cylinders of the slides 14, 15 both fixing bars of the slides 14, 15 interact with the engagement elements 6 because the size "h" of the end portion of each fixing bar is larger than half the stroke "l".

In another version of the advancing system for the coal-winning machine the safety of advancing motion can be attained by alternative changes in the fixing of the slides 14, 15. In this case the fluid flows into the head end of the hydraulic cylinder of the slide 15 and, as soon as the slide has completed a full stroke, i.e. when the fixing bar of the slide 15 has engaged the guide 5, the fluid flows further into the hydraulically and successively connected rod end of the hydraulic cylinder 21 of the slide 14 so that the hydraulic cylinder 21 puts the fixing bar 19 of the slide 14 out of engagement with the guide 5.

After completing the process of changing the fixing of the slides 14 and 15 the fluid enters the head end of the advancing hydraulic cylinder 13. Pushing away from the slide 15 fixed on the guide 5, the hydraulic advancing cylinder 13 moves the advancing mechanism and, consequently, the coal-winning machine 1 in the direction of advancing. After the complete stroke of the advancing hydraulic cylinder 13 the hydraulic system directs the fluid into the head end of the hydraulic cylinder 21 of the slide 14, the fixing of the slides 14, 15 is changed followed by the connection of the advancing hydraulic cylinder 12, and the above-described operating cycle is repeated over again.

Thus, the advancement of the coal-winning machine is accomplished by alternately repeated cycles of movement of the cylinders 12 and 13 and changes in the fixing of the slides 14 and 15.

What is claimed is:

1. Advancing system for moving a coal-winning machine along a face conveyor, comprising: a coal-winning machine located on a face conveyor having end heads;

a guide secured between the end heads adjacent the face conveyor and having rack-type engagement elements arranged throughout its length;

the advancing system having a housing separate from said coal-winning machine whereby the advancing system can be used with selected winning machines, the housing being installed on the guide and being connected with the coal-winning machine by lateral connector means for transmitting advancing forces from the housing to the winning machine;

at least two slides installed in said separate housing and interacting with said guide;

at least two hydraulic cylinders successively interconnected with each other, installed in said separate housing and hinged to the corresponding said slides for moving them along said guide;

grips in the lower part of each of said slides for holding said slides on said guide;

fixing bars mounted in each of said slides and adapted for interaction with the engagement elements of said guide;

at least two hydraulic cylinders, each rigidly connected with a corresponding said slide and interacting with a corresponding said fixing bar so that each of said fixing bar interacts alternatively with the engagement elements of said guide for moving the coal winning machine over said guide.

2. Advancing system as claimed in claim 1 wherein said hydraulic cylinders of the slides have hydraulically communicating rod ends, the size of the portion of each of said fixing bars engaging said guide being greater than half the stroke of the piston of said hydraulic cylinder connected with it.

3. Advancing system as claimed in claim 1 wherein said hydraulic cylinders of said slides have successive hydraulic connection of the head space of one of said hydraulic cylinders with the rod end of the other one.

4. Advancing system as claimed in claim 1 wherein said housing of said advancing mechanism is made in the form of hingedly interconnected individual sections for each pair of said hydraulic cylinders and said slides.

5. Advancing system as claimed in claim 1 wherein the head end of said hydraulic cylinder of said slide is connected hydraulically in succession with the head end of said advancing hydraulic cylinder in each pair of said advancing hydraulic cylinders and said hydraulic cylinders of said slides so that the hydraulic fluid enters the head end of said advancing hydraulic cylinder from the head end of said hydraulic cylinder of the slide after full extension of said fixing bar.

6. Advancing system as claimed in claim 1 wherein said guide has a multiplicity of longitudinal guide pans hinged to one another by connecting links on which said engagement elements are mounted.

7. Advancing system as claimed in claim 6 wherein the engaging elements are made in the form of slots on the connecting links.

8. Advancing system as claimed in claim 1 wherein the lateral connector means includes a hinged joint.

9. Advancing system as claimed in claim 8 wherein the hinged joint is located at one end of the housing.

* * * * *